US006422415B1

(12) United States Patent
Manganiello

(10) Patent No.: US 6,422,415 B1
(45) **Date of Patent: *Jul. 23, 2002**

(54) LEAK-PROOF CUP ASSEMBLY WITH FLOW CONTROL ELEMENT

(75) Inventor: Francis X. Manganiello, Pompton Plains, NJ (US)

(73) Assignee: Playtex Products, Inc., Westport, CT (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/645,975

(22) Filed: Feb. 4, 2000

Related U.S. Application Data

(63) Continuation of application No. 09/019,765, filed on Feb. 6, 1998, now Pat. No. 6,050,445.

(51) Int. Cl.[7] ..... A47G 19/22

(52) U.S. Cl. ..... 220/714; 220/717; 215/11.5; 215/311; 222/482

(58) Field of Search ..... 220/203.02, 203.11, 220/203.17, 203.18, 303, 254, 703, 705, 711, 714, 717, 719, 721, 724, 373, 363, 367.1; 215/11.1, 11.4, 11.5, 902, 311, 387–389, 315, 307, 309, 310; 222/482, 490, 494, 544; 137/588, 512.4, 845; 251/335.2

(56) References Cited

U.S. PATENT DOCUMENTS

| | | | |
|---|---|---|---|
| 4,138 | A | 8/1845 | Pratt |
| 236,583 | A | 1/1881 | Hayes |
| 281,608 | A | 7/1883 | Browne |
| 625,055 | A | 5/1899 | Painter |
| 721,722 | A | 3/1903 | Morton |
| 736,694 | A | 8/1903 | Crane, Jr. |
| 745,477 | A | 12/1903 | Bowers |

(List continued on next page.)

FOREIGN PATENT DOCUMENTS

| | | |
|---|---|---|
| DE | 497999 | 4/1930 |
| DE | 668247 | 11/1937 |
| DE | 2137184 | 2/1973 |
| DE | 26 09 310 | 9/1976 |
| DE | 2128875 | 12/1978 |
| DE | 31 18976 A1 | 12/1982 |

(List continued on next page.)

*Primary Examiner*—Nathan J. Newhouse
(74) *Attorney, Agent, or Firm*—Ohlandt, Greeley, Ruggiero & Perle, LLP

(57) ABSTRACT

A drinking cup assembly including a cup having an open end; a cap adapted to enclose the open end, the cap including a drinking spout and an air vent and mating surfaces adjacent or incorporated into the drinking spout and the air vent; and a flow control valve including two stacks adapted to engage the mating surfaces, each of the two stacks having a concave valve face at a top portion thereof.

23 Claims, 2 Drawing Sheets

U.S. PATENT DOCUMENTS

| | | | |
|---|---|---|---|
| 795,642 | A | 7/1905 | Nelson |
| 820,987 | A | 5/1906 | Perotti |
| 858,898 | A | 7/1907 | McNutt |
| 998,052 | A | 7/1911 | Treiber |
| 1,098,653 | A | 6/1914 | Whisenant |
| 1,122,868 | A | 12/1914 | Davis |
| 1,206,661 | A | 11/1916 | Booth |
| 1,280,942 | A | 10/1918 | Apple |
| 1,360,893 | A | 11/1920 | Cowie |
| 1,366,727 | A | 1/1921 | Gerstner |
| 1,431,762 | A | 10/1922 | Sellers |
| 1,458,366 | A | 6/1923 | Smallwood |
| 1,477,261 | A | 12/1923 | Hart |
| 1,509,734 | A | 9/1924 | Langley |
| 1,825,553 | A | 9/1931 | Smith |
| 1,840,190 | A | 1/1932 | Dyck |
| 1,859,397 | A | 5/1932 | Johnson et al. |
| 1,989,714 | A | 2/1935 | Statham |
| 2,012,113 | A | 8/1935 | Thompson |
| 2,023,267 | A | 12/1935 | Rapt et al. |
| 2,063,424 | A | 12/1936 | Ferguson |
| 2,107,442 | A | 2/1938 | Hughes |
| 2,122,299 | A | 6/1938 | Sloan |
| 2,125,609 | A | 8/1938 | Goodwin |
| 2,162,455 | A | 6/1939 | Hoge |
| 2,174,361 | A | 9/1939 | Condon |
| 2,175,052 | A | 10/1939 | Bull |
| 2,197,766 | A | 4/1940 | Mueller |
| 2,213,465 | A | 9/1940 | Gay |
| 2,223,179 | A | 11/1940 | Lougheed |
| 2,236,031 | A | 3/1941 | Hall |
| 2,321,236 | A | 6/1943 | Parkin |
| 2,372,281 | A | 3/1945 | Jordan |
| 2,414,697 | A | 1/1947 | Pettersson |
| 2,456,989 | A | 12/1948 | Polcyn |
| 2,519,986 | A | 8/1950 | Trout |
| 2,532,729 | A | 12/1950 | Millstein |
| 2,534,614 | A | 12/1950 | Michael |
| 2,544,464 | A | 3/1951 | Matthews et al. |
| 2,557,817 | A | 6/1951 | Dutton |
| 2,569,139 | A | 9/1951 | Abelson |
| 2,584,359 | A | 2/1952 | Miles |
| 2,608,841 | A | 9/1952 | Price |
| 2,622,420 | A | 12/1952 | Rice |
| 2,623,368 | A | 12/1952 | Olsen |
| 2,623,524 | A | 12/1952 | Clemens |
| 2,628,616 | A | 2/1953 | Ransom |
| 2,646,670 | A | 7/1953 | Spalding et al. |
| 2,655,920 | A | 10/1953 | Cronin |
| 2,688,326 | A | 9/1954 | Lerman |
| 2,715,980 | A | 8/1955 | Frick |
| 2,736,446 | A | 2/1956 | Raiche |
| 2,740,229 | A | 4/1956 | Wittwer |
| 2,745,568 | A | 5/1956 | Newton |
| 2,753,068 | A | 7/1956 | Robinson |
| 2,758,755 | A | 8/1956 | Schafler |
| 2,765,639 | A | 10/1956 | Bryant |
| 2,785,841 | A | 3/1957 | Westgate |
| 2,792,696 | A | 5/1957 | Stayart |
| 2,796,062 | A | 6/1957 | Tupper |
| 2,816,548 | A | 12/1957 | Tupper |
| 2,876,772 | A | 3/1959 | Witz |
| 2,950,033 | A | 8/1960 | Henchert |
| 2,989,961 | A | 6/1961 | Blanchett |
| 3,004,566 | A | 10/1961 | Raimo |
| 3,081,006 | A | 3/1963 | Land |
| 3,085,710 | A | 4/1963 | McIlroy |
| 3,139,064 | A | 6/1964 | Harle |
| 3,140,007 | A | 7/1964 | Nettleship |
| 3,143,429 | A | 8/1964 | Swanson et al. |
| 3,179,276 | A | 4/1965 | Safianoff |
| 3,182,843 | A | 5/1965 | Foye |
| 3,241,726 | A | 3/1966 | Chester |
| 3,273,703 | A | 9/1966 | Stribley |
| 3,275,180 | A | 9/1966 | Optner et al. |
| 3,302,644 | A | 2/1967 | Kennedy et al. |
| 3,310,193 | A | 3/1967 | Macpherson |
| 3,342,379 | A | 9/1967 | Foley |
| 3,355,047 | A | 11/1967 | De Sole |
| 3,360,149 | A | 12/1967 | Roth |
| 3,360,161 | A | 12/1967 | Smith |
| 3,366,261 | A | 1/1968 | Dewey |
| 3,372,832 | A | 3/1968 | Yeater et al. |
| 3,393,817 | A | 7/1968 | Meierhoefer |
| 3,424,157 | A | 1/1969 | Di Paolo |
| 3,435,978 | A | 4/1969 | Wittwer |
| 3,438,257 | A | 4/1969 | Nichols et al. |
| 3,438,527 | A | 4/1969 | Gamblin, Jr. |
| 3,445,042 | A | 5/1969 | Elmore et al. |
| 3,490,488 | A | 1/1970 | Grist |
| D216,730 | S | 3/1970 | Carslaw |
| 3,511,407 | A | 5/1970 | Palma |
| 3,635,380 | A | 1/1972 | Fitzgerald |
| 3,650,271 | A | 3/1972 | Pelli |
| 3,669,323 | A | 6/1972 | Harker et al. |
| 3,672,114 | A | 6/1972 | Sacks |
| 3,672,547 | A | 6/1972 | Kozlowski |
| 3,674,183 | A | 7/1972 | Venable et al. |
| 3,704,803 | A | 12/1972 | Ponder |
| 3,704,819 | A | 12/1972 | Lindstrom |
| 3,718,140 | A | 2/1973 | Yamauchi |
| 3,739,938 | A | 6/1973 | Paz |
| 3,785,539 | A | 1/1974 | Wetterek |
| 3,797,696 | A | 3/1974 | Dibrell |
| 3,817,418 | A | 6/1974 | Mastrovito |
| 3,833,154 | A | 9/1974 | Markowitz |
| D233,972 | S | 12/1974 | Juhlin |
| 3,854,617 | A | 12/1974 | Edwards |
| 3,874,563 | A | 4/1975 | Schwartzman |
| 3,878,962 | A | 4/1975 | Holbrook et al. |
| 3,888,373 | A | 6/1975 | Gach et al. |
| 3,905,512 | A | 9/1975 | Albert et al. |
| 3,915,331 | A | 10/1975 | Chenault |
| 3,921,630 | A | 11/1975 | McPhee |
| 3,964,509 | A * | 6/1976 | Daubenberger et al. |
| 3,964,631 | A | 6/1976 | Albert |
| 4,002,168 | A | 1/1977 | Petterson |
| 4,005,799 | A | 2/1977 | Mannaerts |
| 4,051,971 | A | 10/1977 | Saleri et al. |
| 4,057,177 | A | 11/1977 | Laauwe |
| D247,541 | S | 3/1978 | Barger |
| 4,083,467 | A | 4/1978 | Mullins et al. |
| D247,840 | S | 5/1978 | Dixson |
| 4,088,166 | A | 5/1978 | Miller |
| 4,093,096 | A | 6/1978 | Augros |
| 4,098,434 | A | 7/1978 | Uhlig |
| 4,121,731 | A | 10/1978 | Okerstrum |
| 4,133,457 | A | 1/1979 | Klassen |
| 4,135,513 | A | 1/1979 | Arisland |
| 4,138,033 | A | 2/1979 | Payne et al. |
| 4,139,124 | A | 2/1979 | Ferrante |
| 4,146,157 | A | 3/1979 | Dixon, Sr. et al. |
| 4,157,144 | A | 6/1979 | Weiler et al. |
| 4,166,553 | A | 9/1979 | Fraterrigo |
| 4,171,060 | A | 10/1979 | Howard et al. |
| 4,184,604 | A | 1/1980 | Amberg et al. |
| 4,204,604 | A | 5/1980 | Morin et al. |
| 4,238,045 | A | 12/1980 | D'Andria |
| 4,243,156 | A | 1/1981 | Lobbestael |
| 4,245,752 | A | 1/1981 | Prueher |
| D259,231 | S | 5/1981 | Kozlow, Sr. |

| | | | | | |
|---|---|---|---|---|---|
| 4,303,170 | A | | 12/1981 | Panicci | |
| 4,310,101 | A | | 1/1982 | Sekine | |
| 4,314,658 | A | | 2/1982 | Laauwe | |
| 4,340,054 | A | | 7/1982 | Michaels | |
| 4,350,260 | A | | 9/1982 | Prueher | |
| 4,356,935 | A | | 11/1982 | Kamin | |
| 4,361,249 | A | | 11/1982 | Tuneski et al. | |
| 4,388,996 | A | | 6/1983 | Panicci | |
| 4,401,224 | A | | 8/1983 | Alonso | |
| 4,434,810 | A | | 3/1984 | Atkinson | |
| 4,441,623 | A | | 4/1984 | Antoniak | |
| 4,441,624 | A | | 4/1984 | Sokolowski | |
| 4,463,859 | A | | 8/1984 | Greene | |
| 4,470,523 | A | | 9/1984 | Spector | |
| 4,519,518 | A | | 5/1985 | Wiles et al. | |
| 4,519,530 | A | | 5/1985 | Schmidt | |
| D279,752 | S | | 7/1985 | Jagger | |
| 4,540,102 | A | | 9/1985 | Wiedmer | |
| 4,545,491 | A | | 10/1985 | Bisgaard et al. | |
| 4,565,308 | A | | 1/1986 | Yuhl, Jr. | |
| 4,574,970 | A | | 3/1986 | Schwarz | |
| 4,582,214 | A | | 4/1986 | Dart et al. | |
| 4,591,063 | A | | 5/1986 | Geiger | |
| 4,596,341 | A | | 6/1986 | Bruffey | |
| 4,600,111 | A | | 7/1986 | Brown | |
| 4,607,755 | A | | 8/1986 | Andreozzi | |
| 4,613,050 | A | | 9/1986 | Atkin et al. | |
| 4,616,768 | A | | 10/1986 | Flier | |
| 4,620,648 | A | | 11/1986 | Schwartzman | |
| 4,638,918 | A | | 1/1987 | Martinez | |
| 4,640,424 | A | | 2/1987 | White | |
| 4,646,945 | A | | 3/1987 | Steiner et al. | |
| 4,660,747 | A | | 4/1987 | Borg et al. | |
| 4,685,577 | A | | 8/1987 | Chen | |
| D291,659 | S | | 9/1987 | Powell | |
| 4,711,365 | A | | 12/1987 | Fomby | |
| 4,723,668 | A | | 2/1988 | Chen | |
| 4,723,688 | A | | 2/1988 | Munoz | |
| 4,726,484 | A | | 2/1988 | Lutz | |
| 4,728,006 | A | | 3/1988 | Drobish et al. | |
| 4,747,519 | A | | 5/1988 | Green et al. | |
| 4,749,108 | A | | 6/1988 | Dornsbusch et al. | |
| 4,756,440 | A | | 7/1988 | Gartner | |
| 4,760,937 | A | | 8/1988 | Evezich | |
| 4,779,766 | A | | 10/1988 | Kinsley | |
| D298,717 | S | | 11/1988 | Nichols et al. | |
| 4,782,975 | A | | 11/1988 | Coy | |
| 4,785,978 | A | | 11/1988 | Kano et al. | |
| 4,795,063 | A | | 1/1989 | Sekiguchi et al. | |
| 4,796,774 | A | | 1/1989 | Nabinger | |
| 4,801,027 | A | | 1/1989 | Hunter | |
| 4,815,616 | A | | 3/1989 | Silvenis | |
| 4,823,967 | A | | 4/1989 | Thompson | |
| 4,828,126 | A | | 5/1989 | Vincinguerra | |
| 4,828,141 | A | | 5/1989 | Coy | |
| 4,836,404 | A | | 6/1989 | Coy | |
| 4,850,496 | A | | 7/1989 | Rudell et al. | |
| 4,865,207 | A | | 9/1989 | Joyner et al. | |
| 4,909,416 | A | | 3/1990 | Evezich | |
| 4,921,112 | A | | 5/1990 | Juhlin et al. | |
| 4,928,861 | A | | 5/1990 | Schiemann | |
| 4,941,598 | A | | 7/1990 | Lambelet, Jr. et al. | |
| 4,946,062 | A | | 8/1990 | Coy | |
| 4,953,737 | A | | 9/1990 | Meyers | |
| 4,961,510 | A | | 10/1990 | Dvoracek | |
| 4,987,740 | A | | 1/1991 | Coleman | |
| 4,991,745 | A | | 2/1991 | Brown | |
| 4,993,569 | A | | 2/1991 | Osip et al. | |
| 5,005,737 | A | | 4/1991 | Rohr | |
| 5,033,647 | A | | 7/1991 | Smith et al. | |
| 5,033,655 | A | | 7/1991 | Brown | |
| 5,035,340 | A | | 7/1991 | Timmons | |
| 5,040,756 | A | | 8/1991 | Cava | |
| 5,050,758 | A | | 9/1991 | Freeman et al. | |
| 5,060,811 | A | | 10/1991 | Fox | |
| 5,071,017 | A | | 12/1991 | Stull | |
| 5,072,842 | A | | 12/1991 | White | |
| 5,079,013 | A | | 1/1992 | Belanger | |
| 5,099,998 | A | | 3/1992 | Curzon et al. | |
| 5,100,930 | A | | 3/1992 | Fukui et al. | |
| 5,101,991 | A | | 4/1992 | Morifuji et al. | |
| 5,105,976 | A | | 4/1992 | Patterson | |
| 5,115,950 | A | | 5/1992 | Rohr | |
| 5,140,053 | A | | 8/1992 | Yamamoto et al. | |
| 5,147,066 | A | | 9/1992 | Snider | |
| 5,150,800 | A | | 9/1992 | Sarter et al. | |
| 5,186,347 | A | * | 2/1993 | Freeman et al. | 220/714 |
| 5,203,470 | A | | 4/1993 | Brown | |
| 5,211,298 | A | | 5/1993 | Bloch | |
| 5,213,236 | A | | 5/1993 | Brown et al. | |
| 5,275,312 | A | | 1/1994 | Labruzzo | |
| 5,295,597 | A | | 3/1994 | Green | |
| 5,339,995 | A | | 8/1994 | Brown et al. | |
| 5,346,107 | A | | 9/1994 | Bouix et al. | |
| 5,363,983 | A | | 11/1994 | Proshan | |
| 5,366,109 | A | | 11/1994 | Proshan | |
| 5,377,877 | A | | 1/1995 | Brown et al. | |
| D359,417 | S | | 6/1995 | Chen | |
| 5,431,290 | A | | 7/1995 | Vinciguerra | |
| 5,433,338 | A | | 7/1995 | Proshan | |
| 5,433,353 | A | | 7/1995 | Flinn | |
| 5,439,125 | A | | 8/1995 | Bloch | |
| 5,439,143 | A | | 8/1995 | Brown et al. | |
| 5,472,122 | A | | 12/1995 | Appleby | |
| 5,474,028 | A | | 12/1995 | Larson et al. | |
| 5,477,980 | A | | 12/1995 | Chaffin | |
| 5,477,994 | A | | 12/1995 | Feer et al. | |
| 5,490,144 | A | | 2/1996 | Tran et al. | |
| 5,542,670 | A | | 8/1996 | Morano | |
| 5,553,726 | A | | 9/1996 | Park | |
| 5,607,073 | A | | 3/1997 | Forrer | |
| 5,615,809 | A | | 4/1997 | Feer et al. | |
| 5,676,289 | A | | 10/1997 | Gross et al. | |
| 5,680,969 | A | | 10/1997 | Gross | |
| 5,702,025 | A | | 12/1997 | Di Gregorio | |
| 5,706,973 | A | * | 1/1998 | Robbins III, et al. | 220/714 |
| 5,890,620 | A | | 4/1999 | Belcastro | |
| 5,890,621 | A | | 4/1999 | Bachman et al. | |
| 5,988,425 | A | * | 11/1999 | Yehl et al. | 220/714 |
| 6,050,445 | A | * | 4/2000 | Manganiello | 220/714 |
| 6,102,245 | A | * | 8/2000 | Haberman | 220/714 |
| 6,116,457 | A | * | 9/2000 | Haberman | 220/714 |
| RE37,016 | E | * | 1/2001 | Morano | 220/714 |

FOREIGN PATENT DOCUMENTS

| | | | | |
|---|---|---|---|---|
| DE | 39 41 668 | A1 | | 4/1991 |
| DE | 29500819 | | | 4/1995 |
| DE | 29706653 | | * | 8/1997 |
| EP | 0232571 | A1 | | 8/1987 |
| EP | 0257 880 | A1 | | 3/1988 |
| EP | 0265125 | A1 | | 4/1988 |
| EP | 0278 125 | A2 | | 8/1988 |
| EP | 0326 743 | A2 | | 8/1989 |
| EP | 0382 631 | A1 | | 8/1990 |
| EP | 0384394 | A2 | | 8/1990 |
| EP | 0395 380 | A2 | | 10/1990 |
| EP | 0160336 | B1 | | 3/1992 |
| EP | 0555 623 | A1 | | 8/1993 |
| EP | 0634922 | B1 | | 6/1998 |
| FR | 996.998 | | | 12/1951 |
| FR | 1364891 | | | 5/1964 |
| FR | 1437341 | | | 3/1966 |

| | | | |
|---|---|---|---|
| GB | 116872 | | 6/1918 |
| GB | 460274 | | 1/1937 |
| GB | 1046518 | | 10/1966 |
| GB | 1229426 | | 4/1969 |
| GB | 1253398 | | 2/1970 |
| GB | 1447626 | | 8/1976 |
| GB | 1474620 | | 5/1977 |
| GB | 2 015 350 | A | 9/1979 |
| GB | 2 029 379 | A | 3/1980 |
| GB | 2053865 | A | 2/1981 |
| GB | 2 098 958 | A | 12/1982 |
| GB | 2 131 301 | A | 6/1984 |
| GB | 2139903 | A | 11/1984 |
| GB | 2166121 | A | 4/1986 |
| GB | 2 169 210 | A | 7/1986 |
| GB | 2172793 | A | 10/1986 |
| GB | 2183225 | A | 6/1987 |
| GB | 2206106 | A | 12/1988 |
| GB | 2 226 014 | A | 6/1990 |
| GB | 2238729 | A | 5/1991 |
| GB | 2 266 045 | A | 10/1993 |
| GB | 2 279 130 | A | 12/1994 |
| RU | 145824 | | 2/1961 |
| WO | WO93/19718 | | 10/1993 |
| WO | WO94/04023 | | 3/1994 |
| WO | WO97/08979 | | 3/1997 |

* cited by examiner

LEAK-PROOF CUP ASSEMBLY WITH FLOW CONTROL ELEMENT

This is a continuation, of application Ser. No. 09/019,765 filed Feb. 6, 1998, now U.S. Pat. No. 6,050,445.

FIELD OF THE INVENTION

The present invention relates generally to an improved leak-proof cup. More particularly, the present invention relates to a cup assembly having a cap bearing a drinking spout at one side and an air vent spaced from the drinking spout, with a flow control element frictionally engaged in the vicinity of the drinking spout and air vent to allow passage of liquid out and air in during use, while preventing significant leakage through the spout and vent when not in use.

BACKGROUND OF THE INVENTION

Enclosed cups having drinking spouts and separate air vents, which allow the user to drink from the spout without creating excessive vacuum in the cup, are known in the art. However, drinking spouts and air vents are liable to leak liquid stored in the cup between feedings, or if dropped during use. Accordingly, certain cups have been developed that use valving mechanisms at the spout and at the air vent. These valves respond to suction generated during feeding to open and allow liquid to pass through the spout and to allow air to enter the air vent when a vacuum is developed in the interior of the cup.

Two patents disclosing such valves are U.S. Pat. No. 5,079,013 to Belanger and U.S. Pat. No. 5,542,670 to Morano, both commonly assigned or licensed to the assignee of the present application. Applicant hereby incorporates the disclosure of those two patents herein by reference. Applicant has on the market a cup that employs a valve assembly similar to that shown in U.S. Pat. No. 5,079,013 that is secured to sleeves in the underside of the cup's top, but in which the valves are mounted on a single base element. Applicant is also aware of a competitive product having a flow control element of the configuration depicted in FIG. 1, sold as part of the Tumble Mates Spill Proof Cup by the First Years.

Despite the effectiveness of these cup mechanisms, applicant has discovered an improved flow control element and corresponding valve configuration that provides improved fluid flow rates without sacrificing the valve's resistance to spills or the valve's durability.

SUMMARY OF THE INVENTION

Thus, it is an object of the present invention to provide an improved valve mechanism for a cup assembly that is substantially leak-proof even when upended, dropped or shaken.

It is a further object of the present invention to provide an improved valve mechanism for a leak-proof cup that gives higher fluid flow rates at normal suction forces without sacrificing durability or resistance to spills.

It is a further object of the present invention to provide an improved valve mechanism, cap and cup that are easy to clean and easy to assemble.

Accordingly, the present invention provides a drinking cup assembly including a cup having an open end; a cap adapted to enclose the open end, the cap including a drinking spout and an air vent and mating surfaces adjacent or incorporated into the drinking spout and the air vent; and a flow control valve including two stacks adapted to engage the mating surfaces, each of the two stacks having a concave valve face at a top portion thereof.

DESCRIPTION OF THE PREFERRED EMBODIMENTS

Figure 4:
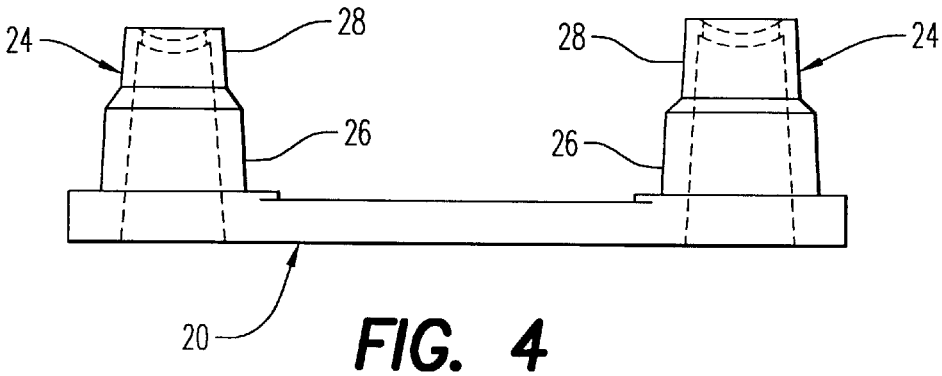
FIG. 4 is a side view of the valve of FIG. 3.
Figure 2:
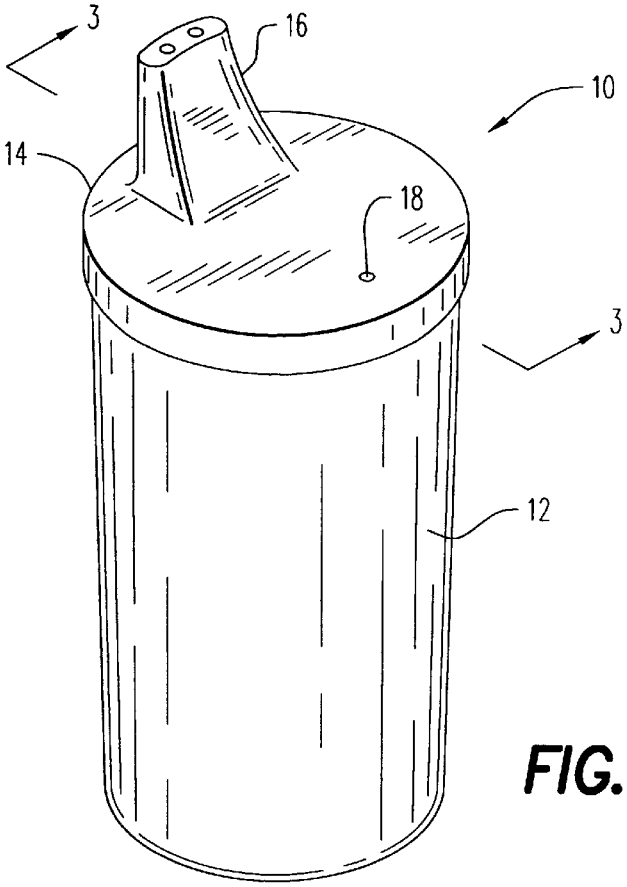
FIG. 2 is a perspective view of a cup, cap and valve assembly according to the present invention.
Figure 3:
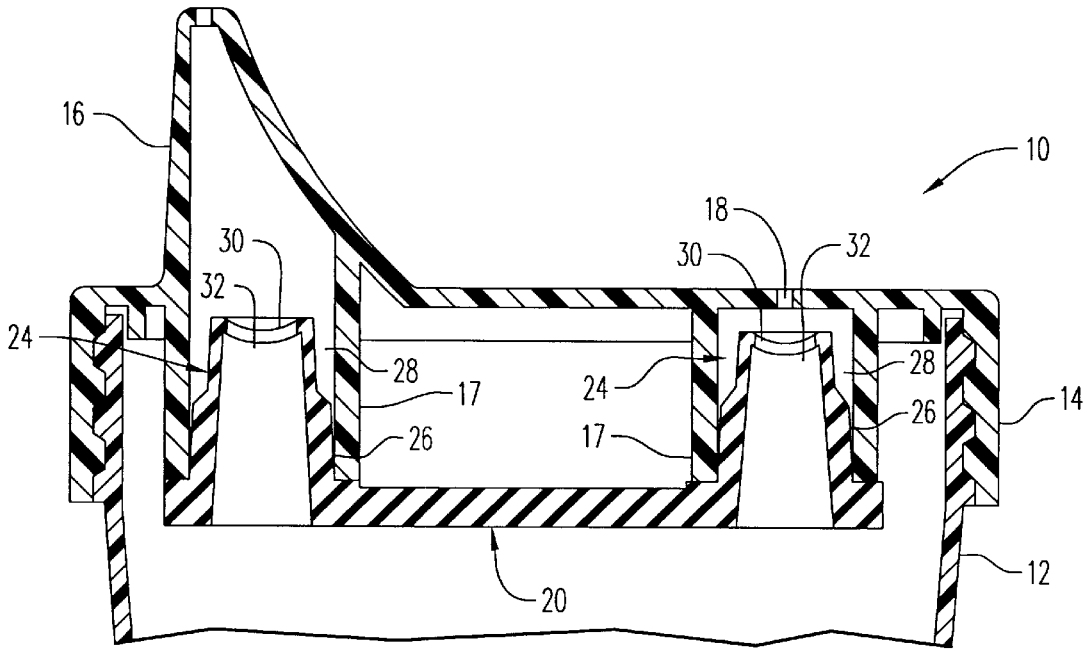
FIG. 3 is a section diagram taken along the lines 3—3' in FIG. 2.

Referring to the figures and, in particular, FIGS. 2 through 4, the cup, cap and valve assembly of the present invention is generally referred to by reference numeral 10 The assembly 10 includes a cup 12, a cap 14 and a flow control valve 20. Cap 14 is adapted to seal cup 12, with the exception of the apertures in the spout 16 and air vent 18 formed in its surface. Flow control valve 20 is adapted to communicate with spout 16 and air vent 18, to form the substantially spill-proof assembly 10.

Cap 14 is formed with mating surfaces, preferably adjacent to or incorporated into spout 16 and air vent 18, to frictionally engage flow control valve 20 and place the flow control valve in fluid communication with spout 16 and air vent 18. In the embodiment depicted in FIG. 2, cap 14 is formed with cylindrical recesses 17 within spout 16 and below air vent 18. These recesses 17 are configured to accept flow control valve 20.

Figure 5:
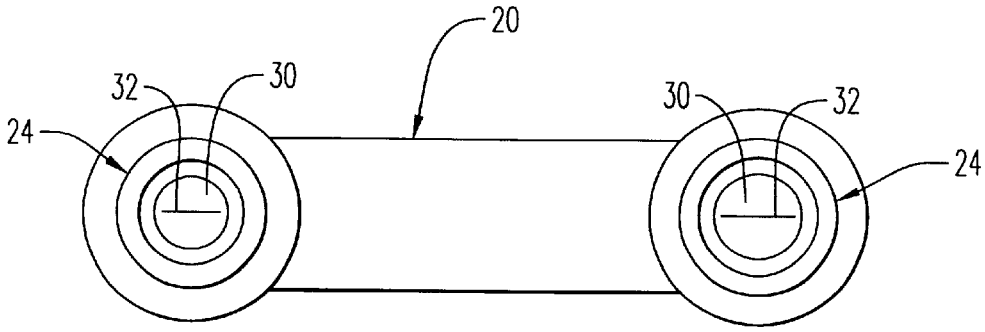
FIG. 5 is a top view of the valve of FIG. 3.

In the embodiment shown in FIGS. 3 through 5, flow control valve 20 includes two stacks 24. Stacks 24 include lower portions 26, upper portions 28 and valve faces 30 bearing slits 32. These stacks 24 are adapted to be pressed into recesses 17 to friction fit flow control valve 20 into cap 14. Accordingly, when recesses 17 have a lower cylindrical portion, as preferred, lower portions 26 of stacks 24 are also preferably substantially cylindrical in shape.

As also shown in FIGS. 3 and 4, each stack 24 is elongated. In addition, each stack 24 is of significant diameter and of substantially equal height. The elongated shape of stacks 24 enables them to place valve faces 30 and slits 32 (see FIG. 5) in close proximity to the apertures in spout 16 and air vent 18. The diameter of stacks 24 permits significant, relatively unconstrained fluid flow to the area of slits 32. It has been found that this arrangement provides optimal balancing of suction needed to open slits 32 and the fluid flow through the slits. Similarly, its substantial cylindrical diameter and resulting inner contour presents a simple, wide opening and tube to enable thorough cleaning of the stacks 24 after use and to minimize the number of corners and niches in which dried or congealed liquid can be deposited. It is preferred that the outer contour of stacks 24 be stepped, as shown in FIGS. 3 and 4, but that the inner contour of the stacks be a constant diameter or of constantly diminishing diameter, thus presenting a smooth, unstepped inner face. Thus, the smooth inner face is preferably either cylindrical, frustoconical, or a combination of the two. This smooth inner face further enhances free fluid flow and promotes easy cleaning of stacks 24. The fact that this preferred flow control valve 20 is easy to clean is very important both to the proper and sanitary functioning of the assembly 10, and also to consumer acceptance of the valve.

It has also been discovered that the preferred concave shape of valve faces 30, in conjunction with the attendant curved shape of slits 32, provides superior fluid flow rate through slits 32 than existing valve configurations. This makes the assembly 10 easier to drink from and less frustrating and tiring to use. Furthermore, it has been found that elongated single slits 32 are preferred to cross-cuts or other types of apertures through valve faces 30 It is also preferred that slits 32 extend substantially from edge to edge of concave valve faces 30.

Most preferably, the radius of curvature of the valve face 30 that is aligned with spout 16 is about 0.267 inches. The most preferred radius of curvature of the valve face 30 that is aligned with air vent 18 is also about 0.267 inches. The most preferred length of slit 32 that is aligned with spout 16 is about 0.235 inches. The most preferred length of slit 32 that is aligned with air vent 18 is about 0.170 inches. The most preferred inner diameter of the stack 24 that is aligned with spout 16 is from about 0.301 inches to about 0.368 inches, ideally a frustoconical shape having the foregoing as minimum and maximum diameters. The most preferred inner diameter of the stack 24 that is aligned with air vent 18 is from about 0.252 inches to about 0.368 inches, ideally a frustoconical shape having the foregoing as minimum and maximum diameters. The most preferred height of the stack 24 that is aligned with spout 16 is about 0.803 inches from top to bottom, and about 0.521 inches from indentation to bottom. The most preferred height of the stack 24 that is aligned with air vent 18 is about 0.730 from top to bottom, and about 0.550 from indentation to bottom. The two stacks 24 are preferably 1.60 inches on center. The preferred outer diameter of the lower portion 26 of the stack 24 that is aligned with spout 16 is about 0.522 inches. The preferred outer diameter of the lower portion 26 of the stack 24 that is aligned with air vent 18 is about 0.457 inches. These dimensions provide an interference fit with a cup lid having cylindrical recesses 17 having preferred inner diameters of about 0.499 inches and about 0.439 inches, respectively. All of the foregoing measurements are subject to a preferred tolerance of plus or minus about 0.005 inches. In addition, a further dimension that is most preferred is the thickness of valve face 30. It is most preferably about 0.023 inches thick, with a preferred tolerance of only about plus or minus 0.002 inches. This dimension has been found to be very important in providing proper flexion of the valve faces 30 and opening of slits 32 under suction during use.

It is preferred that the flow control valve 20 be formed from a single piece of elastomeric material to facilitate easy insertion into and removal from recesses 17. However, flow control valve 20 can be formed of two separate valving elements, each adapted to be inserted into recesses 17 or otherwise engage cap 14. The elastomeric material used is most preferably silicone, but TPE (thermoplastic elastomer), natural rubber, and synthetic rubber (e.g., isoprene) are also preferred.

Figure 1:
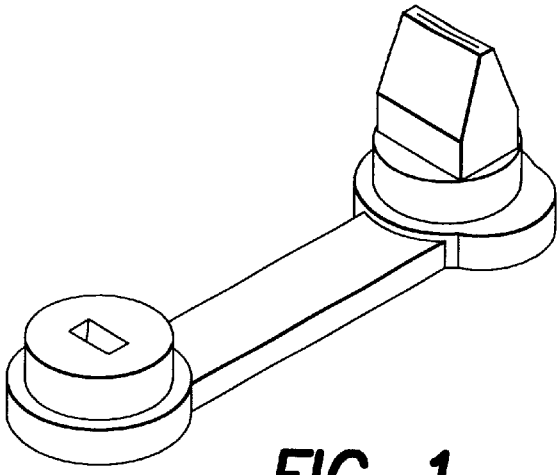
FIG. 1 (PRIOR ART)
FIG. 1 is a perspective view of a prior art valve mechanism.

The following data demonstrate the improved flow rates of a flow control valve 20 according to the present invention. Six samples of a flow control valve as depicted in FIG. 3 (Valve A) were tested against six samples of a flow control valve as depicted in FIG. 1 (Valve B) and against ten samples of a flow control valve as disclosed in U.S. Pat. No. 5,079,013 to Belanger (Valve C).

| Sample Number | Suction to Start Flow (psi) | Suction for Continuous Flow (psi) | Time to Evacuate 100 ml water (sec.) |
|---|---|---|---|
| | | Valve A | |
| 1 | 1.23 | 2.21 | 49 |
| 2 | 1.47 | 2.21 | 37 |
| 3 | 1.47 | 2.46 | 51 |
| 4 | 1.47 | 2.33 | 44 |
| 5 | 1.23 | 2.33 | 56 |
| 6 | 1.23 | 2.21 | 50 |
| Avg. | 1.35 | 2.29 | 48 |
| | | Valve B | |
| 1 | 0.98 | 2.82 | 58 |
| 2 | 0.98 | 2.95 | 41 |
| 3 | 1.72 | 2.46 | 44 |
| 4 | 1.72 | 2.70 | 57 |
| 5 | 1.47 | 2.70 | 63 |
| 6 | 1.23 | 2.46 | 75 |
| Avg. | 1.35 | 2.68 | 56 |
| | | Valve C | |
| 1 | 2.46 | 4.42 | 36 |
| 2 | 2.95 | 4.54 | 27 |
| 3 | 2.95 | 4.42 | 76 |
| 4 | 2.46 | 3.93 | 24 |
| 5 | 2.95 | 4.42 | 38 |
| 6 | 3.19 | 4.17 | 33 |
| 7 | 2.46 | 3.93 | 78 |
| 8 | 3.19 | 4.42 | 29 |
| 9 | 2.46 | 3.93 | 40 |
| 10 | 2.95 | 3.93 | 26 |
| Avg. | 2.80 | 4.21 | 40.7 |

These data show that the Valve A, a valve according to the present invention, requires lower suction to generate a continuous flow than the prior art valves, and requires less time to evacuate 100 ml of water than the prior art elastomeric valve, Valve B. Moreover, this Valve A is more consistent from sample to sample than the controls. This provides a more acceptable product.

Various modifications may be made to the foregoing disclosure as will be apparent to those skilled in the art. Thus, it will be obvious to one of ordinary skill in the art that the foregoing description and drawings are merely illustrative of certain preferred embodiments of the present invention, and that various obvious modifications can be made to these embodiments in accordance with the spirit and scope of the appended claims.

What is claimed is:

1. A drinking cup assembly comprising:

a cup having an open end;

a cap adapted to seal said open end, said cap having a drinking spout and a mating surface, said mating surface being in fluid communication with said spout; and a valving element that has a stack, said stack being sized and configured to engage said mating surface and thereby place said stack in fluid communication with said spout, said stack having a top portion with a concave valve face that extends substantially completely across said top portion and curves inwardly toward said stack.

2. The drinking cup assembly of claim 1, wherein said valve face has a single valve slit therethrough.

3. The drinking cup assembly of claim 2, wherein said valve slit extends substantially completely across said valve face.

4. The drinking cup assembly of claim 1, wherein stack has an upper portion and a lower portion, and wherein said lower portion has an outer diameter that is larger than the outer diameter of said upper portion.

5. The drinking cup assembly of claim 4, wherein only said lower portion of said stack is adapted to engage said mating surface.

6. The drinking cup assembly of claim 5, wherein said mating surface and said upper portion form a gap therebetween.

7. The drinking cup assembly of claim 6, wherein said gap is more than one-half the thickness of said lower portion of said stack.

8. The drinking cup assembly of claim 1, wherein said stack has a smooth inner contour.

9. The drinking cup assembly of claim 8, wherein said inner contour is selected from the shape consisting of cylindrical, frustoconical, and a combination thereof.

10. The drinking cup assembly of claim 1, wherein said valve face is about 0.023 inches thick.

11. The drinking cup assembly of claim 1, wherein said valving element is formed of a single piece of elastomeric material.

12. A drinking cup assembly comprising:

a cup having an open end;

a lid being adapted to seal said open end, said lid having a drinking spout and a mating recess opposite said drinking spout; and a flow control valve having a stack adapted to be removably sealed within said mating recess, said stack having a top portion with a concave valve face that extends substantially completely across said top portion and curves inwardly toward said stack.

13. The drinking cup assembly of claim 12, wherein said valve face has a single valve slit therethrough.

14. The drinking cup assembly of claim 13, wherein said single valve slit extends substantially completely across said valve face.

15. The drinking cup assembly of claim 12, wherein said stack has a hollow interior with a smooth inner contour.

16. The drinking cup assembly of claim 15, wherein said inner contour is selected from the shape consisting of cylindrical, frustoconical, and a combination thereof.

17. The drinking cup assembly of claim 12, wherein said flow control valve is formed of a single piece of elastomeric material.

18. The drinking cup assembly of claim 12, wherein said valve face is about 0.023 inches thick.

19. The drinking cup assembly of claim 12, wherein said stack has an upper portion and a lower portion, and wherein said lower portion has an outer diameter that is larger than the outer diameter of said upper portion.

20. The flow control element of claim 19, wherein only said lower portion of said stack is adapted to be removably sealed within said mating recess.

21. The drinking cup assembly of claim 20, wherein said mating recess and said upper portion of said stack form a gap therebetween.

22. A drinking cup assembly comprising:

a cup having an open end;

a cap adapted to seal said open end, said cap having a drinking spout and a mating surface, said mating surface being in fluid communication with said spout; and a valving element that has a stack, said stack being sized and configured to engage said mating surface and thereby place said stack in fluid communication with said spout, said stack having an upper portion and a lower portion, and wherein said lower portion has an outer diameter that is larger than the outer diameter of said upper portion.

23. The drinking cup assembly of claim 22, wherein said stack has a concave valve face that curves inwardly toward said stack.

* * * * *